US005350310A

United States Patent [19]

Chen

[11] Patent Number: 5,350,310

[45] Date of Patent: Sep. 27, 1994

[54] SOCKET TERMINAL

[76] Inventor: Ken-Ching Chen, 2nd Fl., No. 13, Lane 125, Fu Ying Rd., Hsin Chuang City, Taipei Hsien, Taiwan

[21] Appl. No.: 124,280

[22] Filed: Sep. 20, 1993

[51] Int. Cl.[5] ..... H01R 29/00

[52] U.S. Cl. ..... 439/188; 439/650; 200/51.09

[58] Field of Search ..... 200/51.09, 51.17, 51 R; 439/52, 188, 217, 218, 650, 653

[56] References Cited

U.S. PATENT DOCUMENTS

| | | | |
|---|---|---|---|
| 5,035,635 | 7/1991 | Tsai et al. | 439/188 |
| 5,071,360 | 12/1991 | Lindow et al. | 439/188 X |
| 5,098,307 | 3/1992 | Francisco | 439/188 X |
| 5,112,237 | 5/1992 | Yang | 439/188 |
| 5,259,778 | 11/1993 | Zhang | 439/188 |

*Primary Examiner*—Khiem Nguyen
*Attorney, Agent, or Firm*—Hedman, Gibson & Costigan

[57] ABSTRACT

A socket terminal including a shell, a pair of electrodes linked to the mains power supply and at least one pair of conductive strips for connecting a pair of leads of a device to the pair of electrodes. The pair of conductive strips in a casing rotatable between a first position and a second position relative to the pair of electrodes. The pair of conductive strips contacts the pair of electrodes when the casing in the first position. In a first embodiment, each electrode is a linear strip. Thus, the conductive strips disengage from the electrodes when the casing is in the second position. In a second embodiment, each electrode consists of a linear strip and at least one ear transversely projecting from the linear strip. Thus, the pair of conductive strips engages with the pair of linear strips of the electrodes when the casing is in the first position. The pair of conductive strips engages with the pair of ears when the casing is in the second position.

13 Claims, 6 Drawing Sheets

SOCKET TERMINAL

BACKGROUND OF INVENTION

1. Field of Invention

The present invention relates to a socket terminal including a pair of electrodes connected to the mains power supply and a pair of conductive strips for linking a pair of leads to the electrodes. The pair of conductive strips is rotatable between the "ON" position wherein the pair of conductive strips contacts the pair of electrodes and the "OFF" position wherein the pair of conductive strips does not contact the pair of electrodes.

2. Related Prior Art

Conventionally, a socket terminal has two electrodes linked to the mains power supply and several pairs of conductive strips linked to the electrodes. However, it is sometimes desired to isolate the pair of electrodes from the mains power supply. Therefore, there has been a socket terminal further including a switch arranged between the mains power supply and the pair of electrodes. The pair of electrodes, together with the pairs of conductive strips, can be isolated from the mains power supply by manipulating the switch. However, it is sometimes desired to isolate each pair of conductive strips from the mains power supply regardless of the remaining pairs of conductive strips. Therefore, the present invention is intended to solve the above-mentioned problems.

SUMMARY OF INVENTION

It is an object of the present invention to provide a socket terminal including a shell, a pair of electrodes linked to the mains power supply and at least one pair of conductive strips for connecting a pair of leads of a device to the pair of electrodes. The pair of conductive strips is rotatable between a first position and a second position relative to the pair of electrodes. The pair of conductive strips contacts the pair of electrodes when it in the first position. Each electrode is a linear strip. Thus, the pair of conductive strips disengages from the pair of electrodes when it is in the second position.

It is another object of the present invention to provide a socket terminal including a shell, a pair of electrodes linked to the mains power supply and at least one pair of conductive strips for connecting a pair of leads of a device to the pair of electrodes. The pair of conductive strips is rotatable between a first position and a second position relative to the pair of electrodes. The pair of conductive strips contacts the pair of electrodes when it is in the first position. Each electrode consists of a linear strip and at least one ear transversely projecting from the linear strip. Thus, the pair of conductive strips engages with the pair of linear strips of the electrodes when it is in the first position. The pair of conductive strips engages with the pair of ears when it is in the second position.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
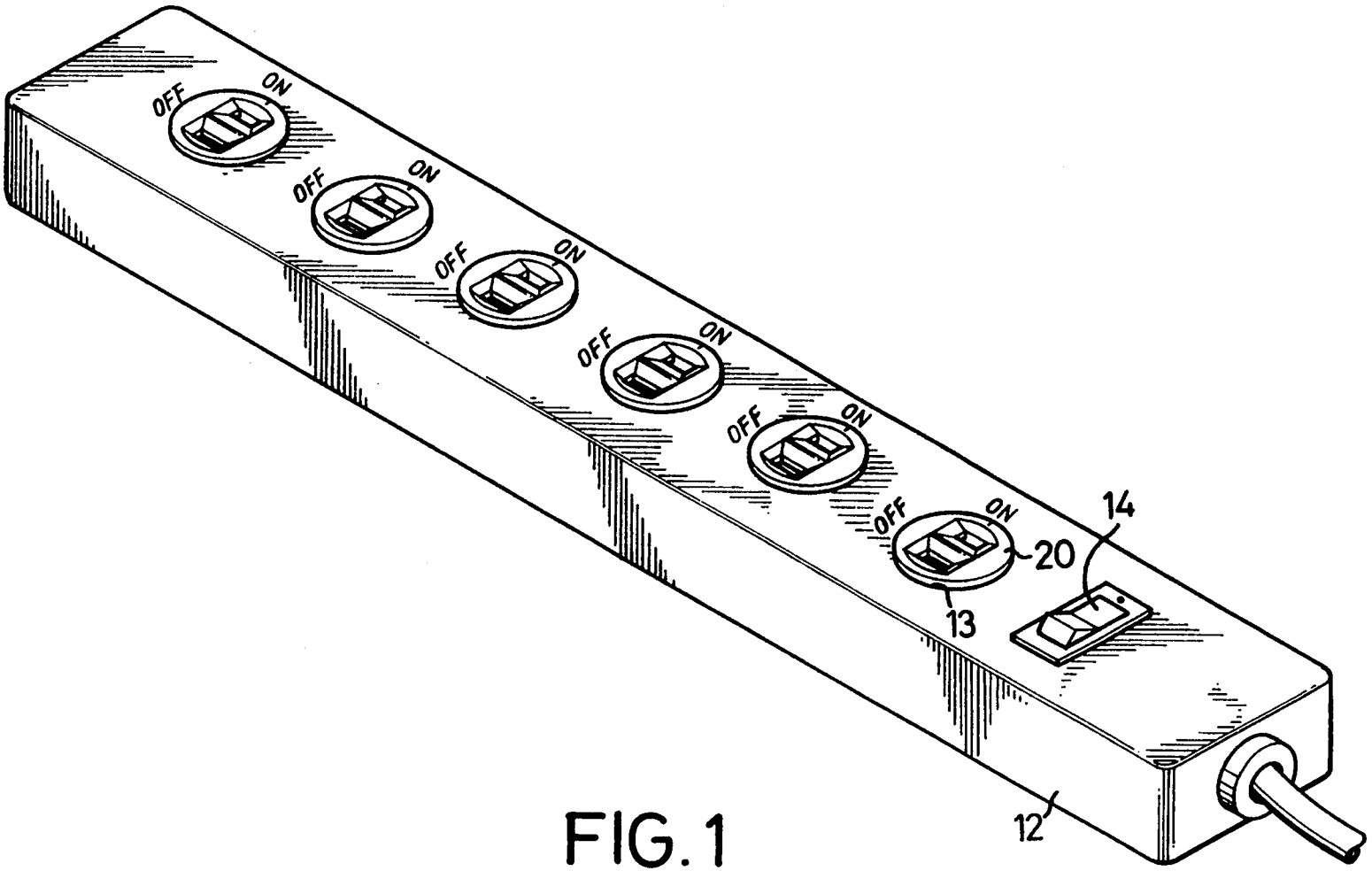
FIG. 1 is a perspective view of six socket members mounted in a shell in accordance with a first embodiment of the present invention.

Referring to FIG. 1, in accordance with a first embodiment of the present invention, a socket terminal has a shell 10 containing a switch 14 and six socket members 20. However, the shell 10 can be made in any size for containing one or more socket members 20.

Figure 2:
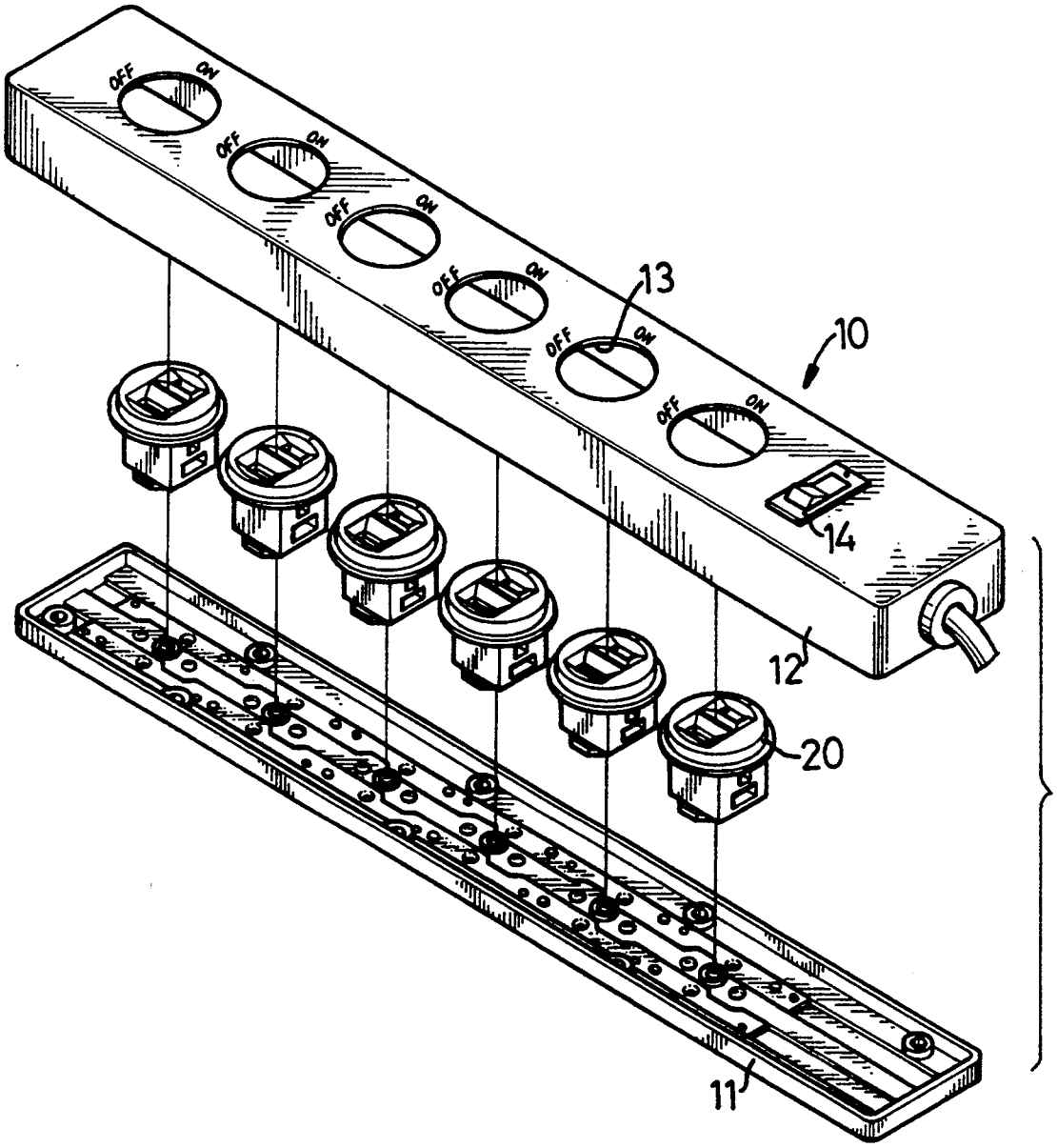
FIG. 2 shows six socket members and a shell including a cover and a base in accordance with a first embodiment of the present invention.

Referring to FIG. 2, the shell 10 consists of a cover 11 and a base 12. The switch 14 is mounted on the base 12. The switch 14 is arranged between the mains power supply and a pair of electrodes 52 so that the mains power supply can be isolated from the electrodes 52 by means of the switch 14. Further details of the switch 14 will not be given as it is well known.

Six circular shaft-receiving holes 13 are formed in the cover 11. The socket members 20 are exposed to the exterior of the shell 10 through the circular shaft-receiving holes 13 so that plugs can engage in the socket members 20. Each socket member 20 includes a pair of conductive strips 30 for contacting the electrodes 52. Each socket member 20 is rotatable between the "ON" position wherein the pair of conductive strips 30 thereof contacts the pair of electrodes 52 and the "OFF" position wherein the pair of conductive strips 30 thereof disengages from the pair of electrodes 52.

Figure 3:
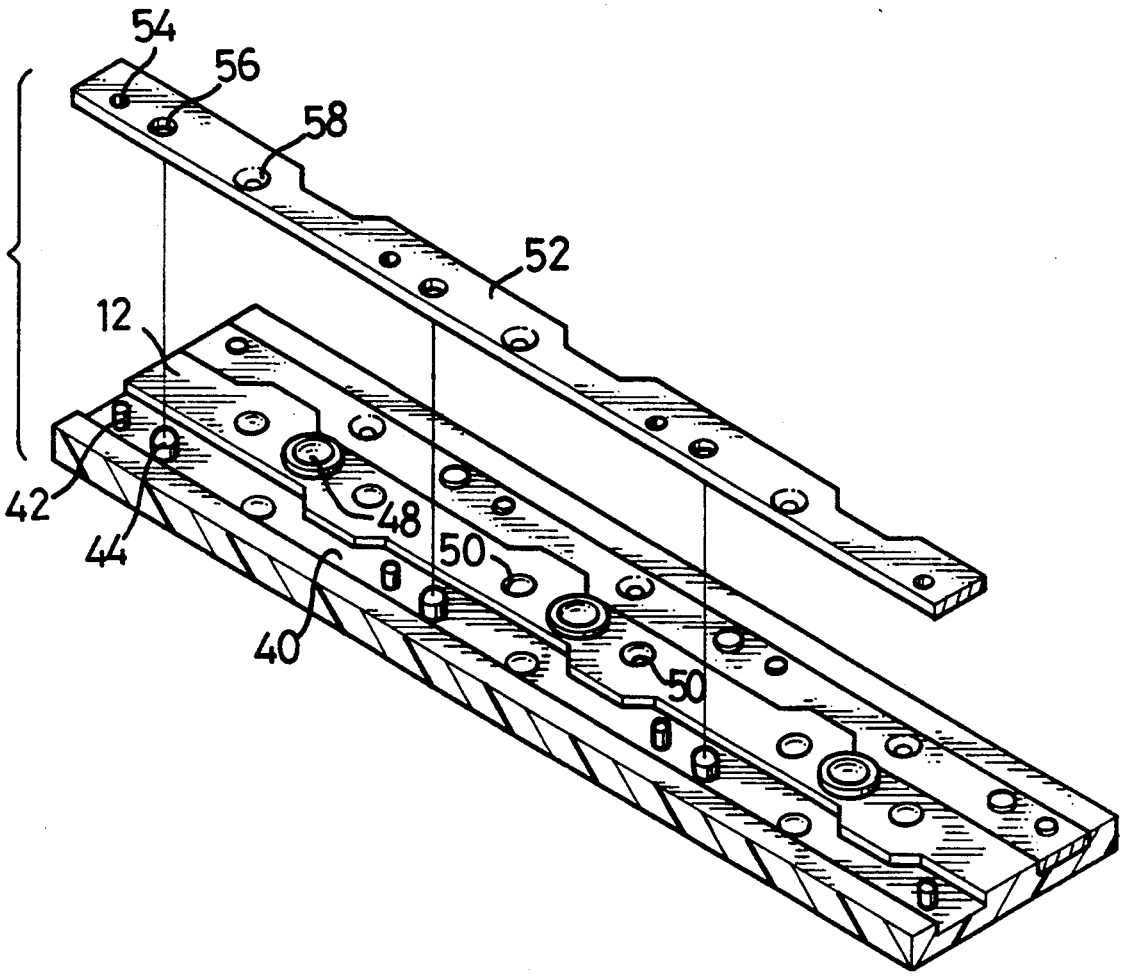
FIG. 3 is an enlarged partial perspective view of a base of a shell and a pair of electrodes in accordance with the first embodiment of the present invention.

Referring to FIG. 3, each electrode 52 is formed as a linear strip of metal, e.g., copper. A number of holes 54 and 56 and female contacts 58 are formed in each of the electrodes 52.

Two separate longitudinal grooves 40 are formed in the base 12. Within the grooves 40, a number of positioning protrusions 42 and locking protrusions 44 are formed on the base 12.

The electrodes 52 are received in the grooves 40 with the positioning protrusions 42 inserted through the holes 54 and with the locking protrusions 44 inserted through the holes 56. As the base 12 is made of plastic, the tips of the locking protrusions 44 can be heat pressed so as to form enlarged heads in order to restrain the electrodes 52 on the base 12.

In another instance, the electrodes 52 can be mounted on the base 12 by means of screws or the like. In such a case, the base 12 is not limited to be made of plastic.

A number of pivot-receiving recesses 48 are formed in the base 12 so that they are arranged along a line between the grooves 40. A number of recesses 50 are formed in the base 12 so that they are in the identical line with pivot-receiving recesses 48. The number of the recesses 50 is twice as many as that of the pivot-receiving recesses 48. Each pivot-receiving recess 48 is at the center of a rectangle formed by two adjacent female contacts 58 and two adjacent recesses 50.

Figure 4:
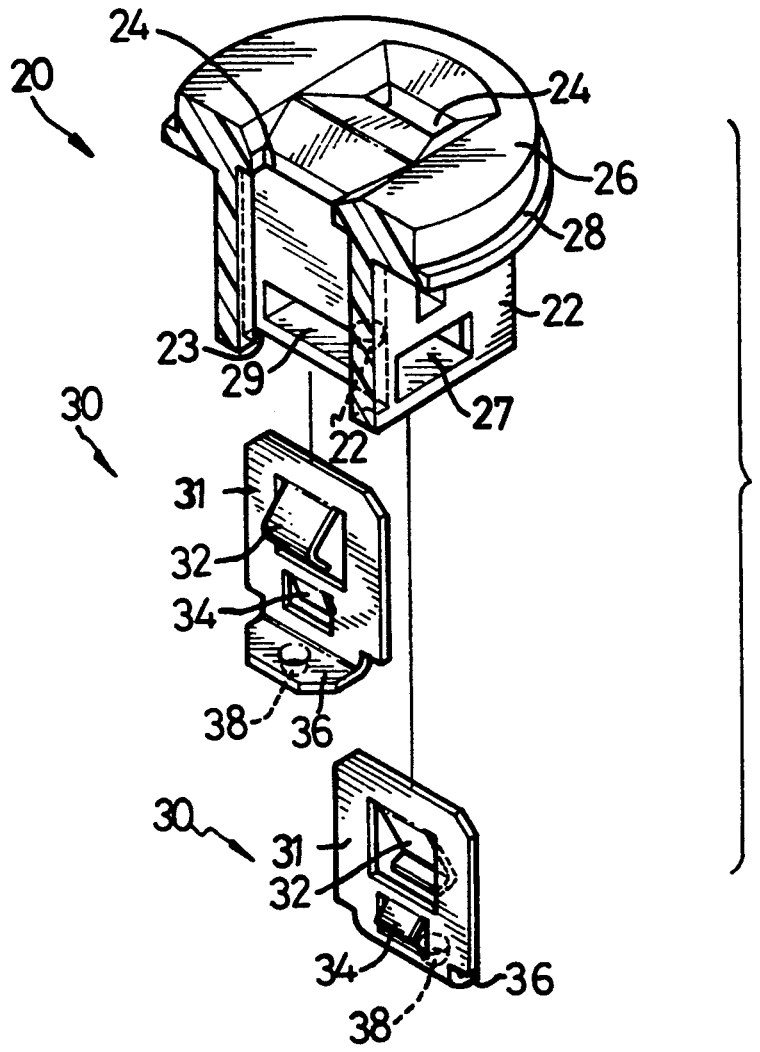
FIG. 4 is an exploded view of a socket member with a casing shown in a partly cross-sectional view in accordance with the present invention.

Referring to FIG. 4, each socket member 20 has a substantially cubic casing 22, a pivot 21 centrally formed on the underside of the casing 22, a disk-shaped shaft 26 formed on the upperside of the casing 22 and an annular flange 28 formed about the disk-shaped shaft 26.

Two slots 24 are formed through the casing so that a partition is formed between the slots 24. Within each slot 24, two female tracks 22 are formed in the casing 22. Two snapping member-receiving recesses 29 are formed in two opposite sides of the partition. An opening 27 is formed in the casing 22 so that the snapping member-receiving recesses 29 are accessible through the opening 27.

Each conductive strip 30 has a lead-contacting strip 31 and an electrode-contacting strip 36. The lead-contacting strips 31 each have two vertical rims, an upper horizontal rim and a lower horizontal rim. Each of the lead-contacting strips 31 is formed with a first press-out extending downwardly and a second press-out extending downwardly. The first press-out is further curved so as to form a lead-contacting tab 32. The second press-out acts as a snapping member 34. Each of the lead-contacting strips 31 is inserted in one of the slots 24. Two vertical edges of the lead-contacting strips 31 are received in the female tracks 23 so that the lead-contacting strips 31 will not pivot in the slots 24. The snapping members 34 of the lead-contacting strips 31 engage in the snapping member-receiving recesses 29 so that the lead-contacting strips 31 will not slide out of the slots 24. Thus, the lead-contacting strips 31 are firmly received in the slots 24.

An electrode-contacting strip 36 perpendicularly projects from the lower rim of each of the lead-contacting strips 31. Each of the electrode-contacting strips 36 is punched so as to form a downward male contact 38.

Each socket member 20 is rotatable in the shell 10, as the disk-shaped shaft 26 thereof is inserted through one of the shaft-receiving holes 13 and the pivot 21 thereof is received in one of the pivot-receiving recesses 48. The socket members 20 are retained in the shell 10 by means of the annular flanges 28.

Figure 5:
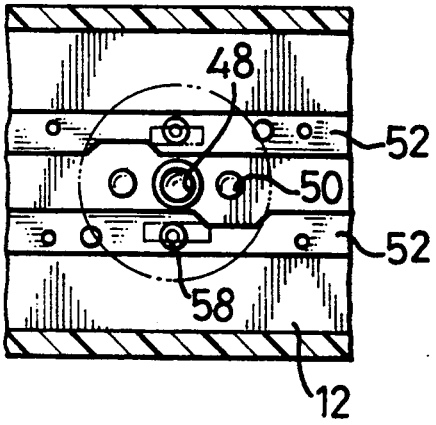
FIG. 5 is an enlarged partial top view of a base of a shell and a pair of electrodes in accordance with the first embodiment of the present invention, further showing in phantom lines a socket member in the "ON" position.

Referring to FIG. 5, the male contacts 38 (not shown) engage in two female contacts 58 each formed in one of the electrodes 52. That is, the electrode-contacting strips 36 engage with the electrodes 52. Accordingly, the lead-contacting strips 31 (not shown) engage with the mains. Therefore, the socket member 20 is retained in the "ON" position.

Obviously, the electrode-contacting strips 36 can directly contact the electrodes 52 without the engagement between the male contacts 38 and the female contacts 58. However, the male contacts and the female contacts make possible a better engagement between the lead-contacting strips 31 and the electrodes 52.

Figure 6:
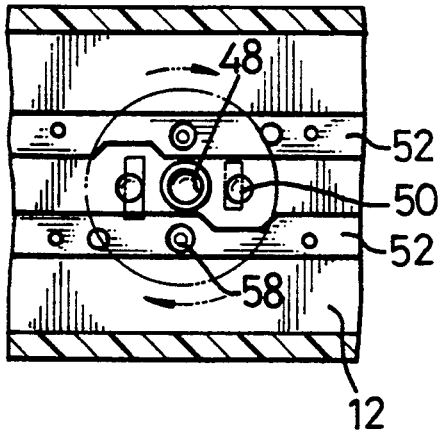
FIG. 6 is an enlarged partial top view of a base of a shell and a pair of electrodes in accordance with the first embodiment of the present invention, further showing in phantom lines a socket member in the "OFF" position.

Referring to FIG. 6, the socket member 20 is rotatable in a direction indicated with two arrows. The socket member 20 is retained in the "OFF" position as the lead-contacting strips 31 disengage from the mains. It is preferred that the socket member 20 is moved to a position so that the female contacts 38 engage in two recesses 50.

Obviously, regardless of the engagement between the male contacts 38 and the recesses 50, the socket member 20 is retained in the "OFF" position when the electrode-contacting strips 36 disengage from the electrodes 52. However, the engagement between the male contacts 38 and the recesses 50 ensures that the socket member 20 can be firmly retained in the "OFF" position.

The socket terminal employs six socket members as described above, however, a socket terminal may employ a single socket member.

Figure 7:
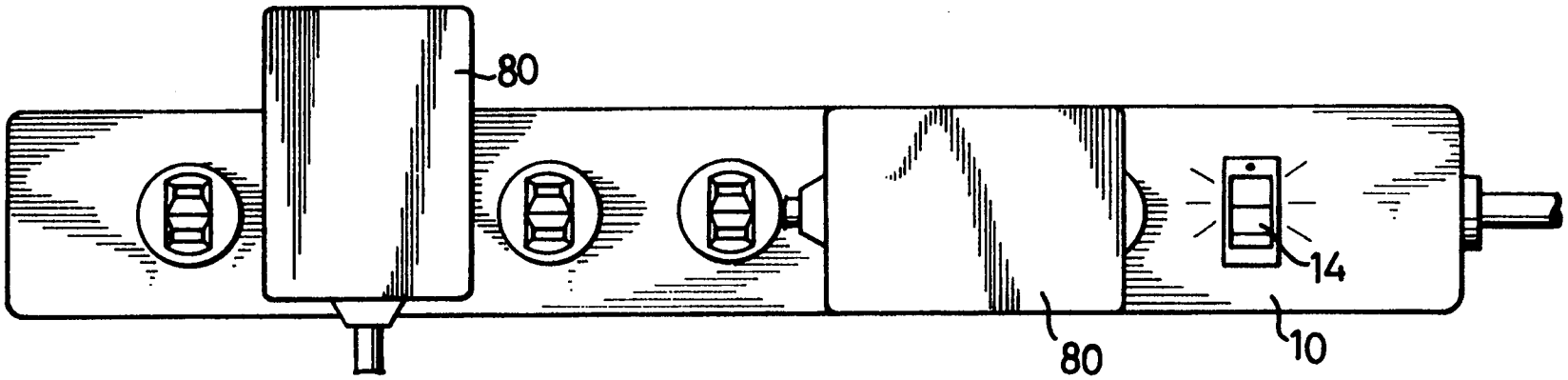
FIG. 7 is a top view of six socket members mounted in a shell in accordance with a second first embodiment of the present invention.

Referring to FIG. 7, two voltage converters 80 electrically engage with two of six socket members 20 mounted on a shell. One of the voltage converters 80 engage with one of the socket members 20 such that the length of the former is parallel to the length of the latter. This voltage converter 80 obscures two adjacent socket members 20, this is not desired. It is desired that a voltage converter 80 obscures only one of the socket members 20, as the remaining of the voltage converters 80 which has a width extending parallel to the length of the shell.

Figure 8:
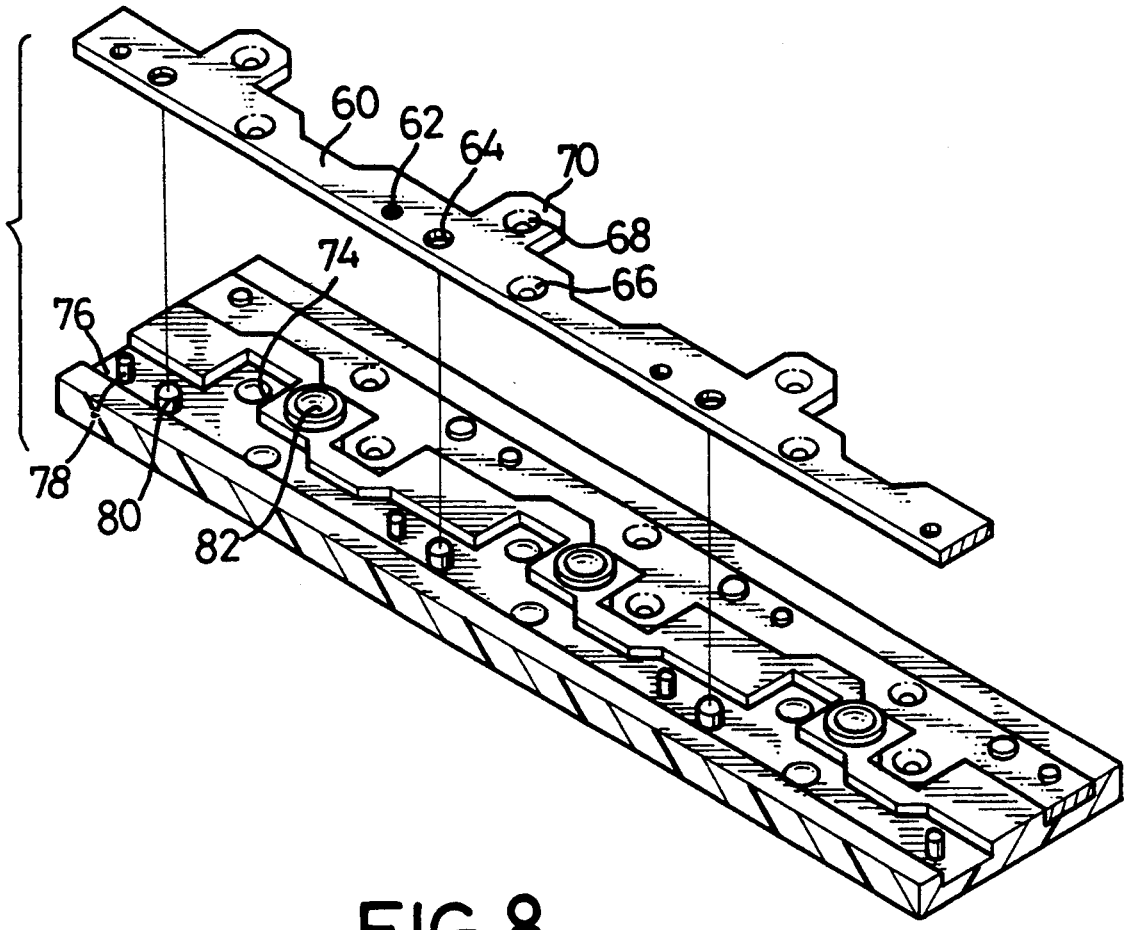
FIG. 8 is an enlarged partial perspective view of a base of a shell and a pair of electrodes in accordance with the second embodiment of the present invention.

Referring to FIG. 8, two electrodes 60 in accordance with a second embodiment of the present invention make each of the socket members 20 have a first "ON" position so that it is suitable for receiving an ordinary plug and a second "ON" so that it is suitable for receiving a voltage converter.

Similar to the electrodes 52, the electrodes 60 each have a number of holes 62 and 64 and female contacts 66. Unlike the electrodes 52, the electrodes 60 each have a number of female contacts 68 formed in a corresponding number of ears 70 transversely protruding therefrom.

Similar to the base 12, a base 74 defines two grooves 76 corresponding to the electrodes 60. Within the grooves 76, a number of positioning protrusions 78 and locking protrusions 80 are formed on the base 74. A number of pivot-receiving recesses 82 are formed in the base 74 along a central length of the latter.

The electrodes 60 are mounted in the grooves 76 while the positioning protrusions 78 are inserted through the holes 62 and the locking protrusions 80 are inserted through the holes 64. The tips of the locking protrusions 80 are then pressed by means of an iron so that they are formed as enlarged heads for restraining the electrodes 60 on the base 74. At this instant, each pivot-receiving recess 82 is at the center of a rectangle formed by two adjacent female contacts 66 and two adjacent female contacts 68.

Each socket member 20 is mounted in the shell with the disk-shaped shaft 26 thereof inserted through one of the shaft-receiving holes 13 and with the pivot 21 thereof received in one of the pivot-receiving recesses 82, so that it is rotatable about an axis passing though the disk-shaped shaft 26 and pivot 21 thereof. The socket members 20 are restrained in the shell 10 by means of the annular flanges 28.

Figure 9:
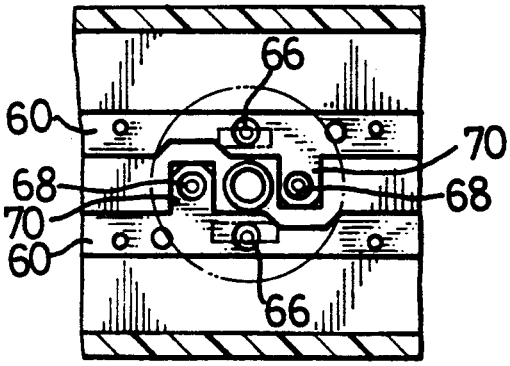
FIG. 9 is an enlarged partial top view of a base of a shell and a pair of electrodes in accordance with the second embodiment of the present invention, further showing in phantom lines a socket member in a first "ON" position.

Referring to FIG. 9, the male contacts 38 engage in two female contacts 66 each formed in one of the electrodes 60. That is, the electrode-contacting strips 36 engage with the electrodes 60. Accordingly, the lead-contacting strips 31 engage with the mains power supply. Therefore, the socket member 20 is retained in the first "ON" position.

Figure 10:
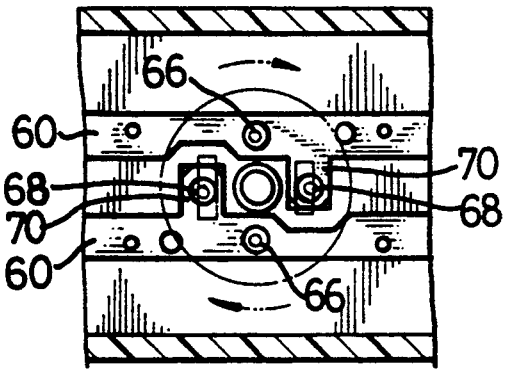
FIG. 10 is an enlarged partial top view of a base of a shell and a pair of electrodes in accordance with the second embodiment of the present invention, further showing in phantom lines a socket member in a second "ON" position.

Referring to FIG. 10, the socket member 20 is rotatable in a direction indicated with two arrows. The male contacts 38 disengage from the female contacts 66 in order to engage in two female contacts 68. That is, the electrode-contacting strips 36 engage with the electrodes 60. Accordingly, the lead-contacting strips 31 engage with the mains. Therefore, the socket member 20 is retained in the second "ON" position.

Obviously, the electrode-contacting strips 36 can directly contact the electrodes 60 (ears 70) without the engagement between the male contacts 38 and the female contacts 66 (female contacts 68). However, the male contacts and the female contacts make possible a better engagement between the lead-contacting strips 31 and the electrodes 60.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A socket terminal comprising:

a shell comprising a base and a cover which is mounted on the base, wherein the base defines at least one pivot-receiving recess and wherein the cover defines at least one shaft-receiving hole;

two electrodes which are mounted on the base and connected to a power supply;

at least one socket member comprising:

a casing comprising a pivot formed on a side and a disk-shaped shaft formed on an opposite side, whereby the pivot is received in the pivot-receiving recess and the disk-shaped shaft is received in the shaft-receiving hole, so that the casing is rotatable between a first position and a second position; and two conductive strips which are received in the casing so that they contact the electrodes when the casing is in the first position and that they do not contact the electrodes when the casing is in the second position.

2. A socket terminal in accordance with claim 1, wherein the base comprises a pair of grooves formed therein in order to receive the pair of electrodes.

3. A socket terminal in accordance with claim 1, wherein the base comprises a number of plastic locking protrusions formed thereon, and wherein the pair of electrodes comprises a number of holes formed therein, whereby the plastic locking protrusions are insertable through the holes and the tips thereof are heat pressed so as to form enlarged heads in order to restrain the pair of electrodes on the base.

4. A socket terminal in accordance with claim 1, wherein the casing comprises an annular flange formed about the disk-shaped shaft in order to keep the casing in the shell.

5. A socket terminal in accordance with claim 1, wherein the casing comprises two slots defined therethrough in order to receive the conductive strips.

6. A socket terminal in accordance with claim 5, wherein each conductive strip comprises a lead-contacting strip and an electrode-contacting strip projecting from the lead-contacting strip, the lead-contacting strips are inserted in the slots for contacting leads of electrical devices while the electrode-contacting strips are retained outsides the casing for contacting the electrodes.

7. A socket terminal in accordance with claim 6, wherein each lead-contacting strip comprises a press-out acting as a lead-contacting tab for firmly contacting the leads.

8. A socket terminal in accordance with claim 6, wherein each conductive strip comprises a press-out acting as a snapping member, the casing comprises a partition formed between the slots, and the partition comprises two snapping member-receiving recesses formed therein for receiving the snapping members when the conductive strips are inserted in the slots.

9. A socket terminal in accordance with claim 6, wherein each electrode-contacting strip comprises a contact and the each electrode comprises at least one contact, the contacts formed on the electrode-contacting strips engage with the contacts formed on the electrodes when the casing is in the first position.

10. A socket terminal in accordance with claim 1, wherein each electrodes comprises at least one ear transversely projecting therefrom for contacting the conductive strips.

11. A socket terminal in accordance with claim 10, wherein the pair of conductive strips contact the pair of ears when the casing is in the second position.

12. A socket terminal in accordance with claim 11, wherein each conductive strip comprises a lead-contacting strip and an electrode-contacting strip projecting from the lead-contacting strip, the lead-contacting strips are inserted in slots of the casing for contacting leads of an electrical device while the electrode-contacting strips are retained outsides the casing for contacting the electrodes.

13. A socket terminal in accordance with claim 12, wherein each electrode-contacting strip comprises a contact, each electrode comprises at least one contact, each ear comprises a contact, the contacts of the electrode-contacting engage with the contacts of the electrodes when they are in the first position, the contacts of the electrode-contacting engage with the ears when they are in the second position.

* * * * *